US005188022A

United States Patent [19]

Benson et al.

[11] Patent Number: 5,188,022

[45] Date of Patent: Feb. 23, 1993

[54] COUNTERTOP CAN CRUSHER

[75] Inventors: John D. Benson, 3935 Nokomis Ave. South, Minneapolis, Minn. 55406; Ivan B. Erickson, Minneapolis, Minn.

[73] Assignee: John D. Benson, Minneapolis, Minn.

[21] Appl. No.: 771,326

[22] Filed: Oct. 2, 1991

Related U.S. Application Data

[63] Continuation-in-part of Ser. No. 426,112, Oct. 24, 1989, abandoned.

[51] Int. Cl.[5] ..... B30B 15/14; B30B 1/24; B30B 9/32

[52] U.S. Cl. ..... 100/52; 100/53; 100/98 R; 100/288; 100/902

[58] Field of Search ..... 100/48, 50, 52, 53, 100/98 R, 240, 245, 288, 902, 256

[56] References Cited

U.S. PATENT DOCUMENTS

| | | | |
|---|---|---|---|
| 594,134 | 11/1897 | Furbush | 100/52 |
| 1,880,873 | 10/1932 | Derry | 100/288 X |
| 2,240,630 | 5/1941 | Stacy | 100/53 X |
| 3,025,837 | 3/1962 | Beach | 100/52 X |
| 3,079,856 | 3/1963 | Swartz | 100/902 X |
| 3,104,607 | 9/1963 | Galas | 100/902 X |
| 3,108,533 | 10/1963 | Read et al. | 100/53 X |
| 3,208,372 | 9/1965 | Taylor | 100/902 X |
| 3,232,220 | 2/1966 | Sileski | 100/902 X |
| 3,315,594 | 4/1967 | Simshauser | 100/902 X |
| 3,352,230 | 11/1967 | Hunnicutt | 100/902 X |
| 3,580,167 | 5/1971 | Simshauser | 100/52 |
| 3,669,010 | 6/1972 | Lundgren | 100/52 |
| 3,727,546 | 4/1973 | McKinney | 100/52 X |
| 3,889,587 | 6/1975 | Wharton | 100/288 X |
| 3,960,070 | 6/1976 | McClure et al. | 100/902 X |
| 3,968,743 | 7/1976 | Scherrer | 100/52 |
| 4,073,227 | 2/1978 | Moriconi | 100/52 |
| 4,103,609 | 8/1978 | Hiatt | 100/902 X |
| 4,126,160 | 11/1978 | Gurtler | 100/902 X |
| 4,133,261 | 1/1979 | Belfils | 100/902 X |
| 4,141,493 | 2/1979 | Arp | 100/902 X |
| 4,240,341 | 12/1980 | Whipple et al. | 100/902 X |

(List continued on next page.)

FOREIGN PATENT DOCUMENTS

| | | | |
|---|---|---|---|
| 96150 | 3/1898 | Fed. Rep. of Germany | 100/288 |
| 57-142797 | 9/1982 | Japan | 100/902 |
| 60-6297 | 1/1985 | Japan | 100/902 |
| 8034 | of 1839 | United Kingdom | 100/288 |
| 1052583 | 12/1966 | United Kingdom | 100/52 |

OTHER PUBLICATIONS

Catalog pages 12 and G91 from Hammacher Schlemmer catalog, 2 page document (attachment A) dated Dec. 2, 1991 relating to can crusher product by Sjoberg, and 8 page document (attachment B) relating to Sjoberg can crusher product dated 1991.

*Primary Examiner*—Harvey C. Hornsby
*Assistant Examiner*—Stephen F. Gerrity
*Attorney, Agent, or Firm*—Merchant, Gould, Smith, Edell, Welter & Schmidt

[57] ABSTRACT

An apparatus for crushing workpieces includes a drive mechanism having a gear reduction train and a moveable rack member which is centered above a compression plate for even, linear force transmission. Force is transmitted to the rack member on two opposite sides thereof by a pair of pinions which engage opposite rows of rack teeth. The compression plate is integral with a pair of opposite guide sleeves, which are mounted for sliding movement with respect to vertically extending guideposts. A crimper mechanism is mounted to the compression plate for crimping the workpiece prior to compression. The combination of the improved drive train, which prevents jamming of the apparatus due to uneven force transmission, and the crimper mechanism allows a relatively small motor to be used in the unit, which increases its portability, economy and affordability. An additional aspect of the invention involves an overload sensor arrangement, which causes the apparatus to reverse in mid-stroke if too much compressive force is being generated between the compression plate and the workpiece. A door interlock switch arrangement makes the apparatus safer for use by children or other persons.

4 Claims, 9 Drawing Sheets

U.S. PATENT DOCUMENTS

| | | | |
|---|---|---|---|
| 4,265,170 | 5/1981 | Schulze, Jr. | 100/902 X |
| 4,291,618 | 9/1981 | Heiser et al. | 100/902 X |
| 4,296,683 | 10/1981 | Lidik et al. | 100/902 X |
| 4,298,114 | 11/1981 | Nagai et al. | 100/53 X |
| 4,395,641 | 7/1983 | Dise | 100/53 X |
| 4,457,418 | 7/1984 | Johnston | 100/53 X |
| 4,475,449 | 10/1984 | Gianelo | 100/902 X |
| 4,489,649 | 12/1984 | Daugherty | 100/902 X |
| 4,570,536 | 2/1986 | Dodd | 100/53 |
| 4,606,265 | 8/1986 | Meier | 100/288 X |
| 4,771,686 | 9/1988 | Triantos, Jr. | 100/902 X |
| 4,809,600 | 3/1989 | Yamamoto et al. | 100/902 X |

COUNTERTOP CAN CRUSHER

This is a continuation-in-part of U.S. patent application Ser. No. 07/426,112, filed Oct. 24, 1989, now abandoned.

BACKGROUND OF THE INVENTION

1. Field of the Invention

This invention relates to machines which are used to promote resource recycling efforts. More specifically, this invention relates to an improved apparatus for crushing workpieces such as aluminum and steel beverage cans.

2. Description of the Prior Art

As the known deposits of minerals in the earth become exhausted and more expensive to recover, industry is beginning to find that recycled resources are becoming increasingly cost competitive. The decreasing availability of space which is usable for waste disposal has also caused environmentalists and urban planners alike to support increased recycling efforts throughout society.

As community recycling programs proliferate, more time and money is being devoted to the logistics which are involved in the collection and recovery of recoverable waste materials. To this end, programs are encouraging their participants to crush metal cans prior to collection in order to reduce their volume during transport. However, crushing such containers by hand or by foot is usually inefficient and is sometimes dangerous.

Although can crushing machines exist, none to date have proven to be very successful in the commercial and residential realm. One reason for this is that existing designs have required fairly large electric motors in order to generate the torque which is necessary to crush a can. This has made such machines relatively heavy and expensive. Other disadvantages of some of the existing designs is their tendency to jam during operation due to uneven force transmission, and a tendency for the motor to be damaged when an unyielding workpiece is engaged.

It is clear that there has existed a long and unfilled need in the art for a can crusher which is relatively light and inexpensive, which is less likely to jam during operation, and which is protected against overload when an unyielding workpiece is engaged.

SUMMARY OF THE INVENTION

Accordingly, it is an object of the invention to provide an apparatus for crushing workpieces, which is relatively light and inexpensive.

It is further an object of the invention to provide a crusher which is less likely to jam during operation than those designs which are previously known, and which is protected against overload when an unyielding workpiece is engaged.

It is yet further an object of the invention to provide an apparatus for crushing workpieces which is relatively simple and safe to use.

In order to achieve these and other objects of the invention, an apparatus for crushing a workpiece according to a first aspect of the invention includes a housing having an opening defined therein for receiving a workpiece; a compression member mounted for movement along a linear path within the housing; drive structure for moving the compression member along the linear path; structure for sensing compressive force between the compressive member and the drive structure; and structure for controlling the drive structure so that, upon actuation, the compression member is caused to move from an initial position downwardly to a lower limit position, and then upwardly to the initial position, whereby an object which is positioned within the opening may be crushed.

According to a second aspect of the invention, an apparatus for crushing a workpiece may include a housing having an opening defined therein for receiving a workpiece such as a can; a compression member mounted for movement along a linear path within the housing; and drive structure for moving the compression member along the linear path, the drive structure including an elongate, axially movable rack member, the rack member being substantially centered above the compression member and having first and second tooth racks, respectively, on opposite sides thereof, the drive means further including a motor, and gearing structure to transmit force from the motor to the first and second tooth racks, whereby force is transmitted evenly to the compression member so as to lessen the possibility of jamming.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
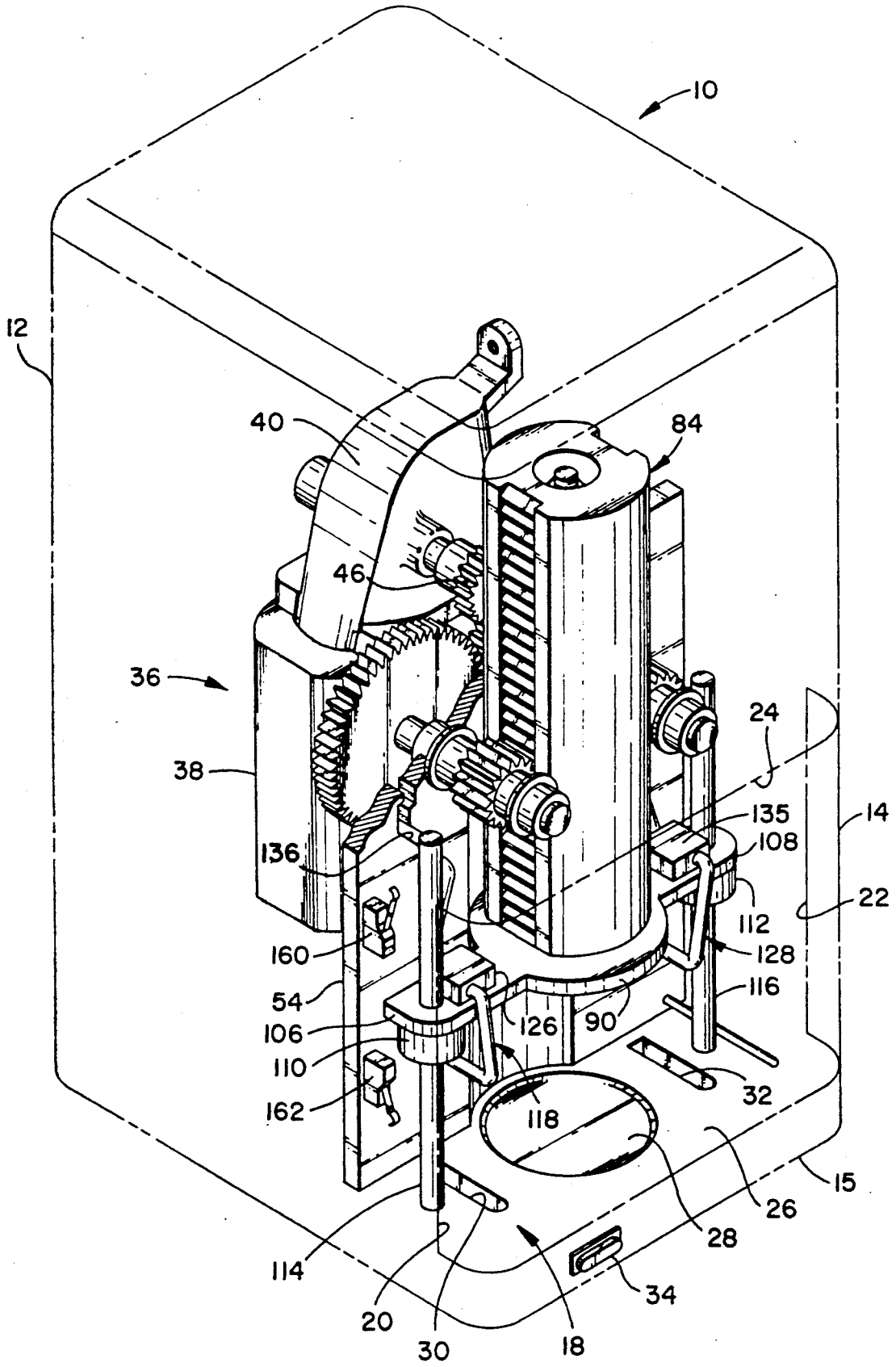
FIG. 1 is a perspective view of a can crusher constructed according to a preferred embodiment of the invention, with an outer housing thereof being shown in broken line only.

Referring now to the drawings, wherein like reference numerals designate corresponding structure throughout the views, and referring in particular to FIG. 1, an improved can crusher 10 constructed according to preferred embodiment of the invention includes an outer housing 12 which is illustrated in broken lines in FIG. 1 for purposes of clarity. The housing 12 includes a base 15. Base 15 has a flat lower surface with four rubber feet 17, which enables the can crusher 10 to be set upon a flat support surface such as a kitchen counter top. As may further be seen in FIG. 1, an opening 18 is defined in one side of the housing 12 for receiving a workpiece such as an aluminum or steel can which is to be crushed. Opening 18 is defined in housing 12 by a pair of side edges 20, 22, a top edge 24 and a top surface 26 of the base 15. A door 14 is pivotally supported relative to housing 12 by one or more hinges 16, shown in FIGS. 4 and 5, so as to enable an operator to open or close opening 18 for insertion or removal of the workpiece.

As may further be seen in FIG. 1, a circular depression 28 is defined in the top surface 26 of base 15 for supporting a lower surface of the workpiece. Depression 28 lessens the likelihood of a workpiece shifting during operation of the can crusher 10. A first groove 30 and a second groove 32 are also defined in the top surface 26, for purposes which will be described in greater detail hereinbelow. A start button 34 is placed on an external surface of housing 12, preferably beneath opening 18.

Figure 2:
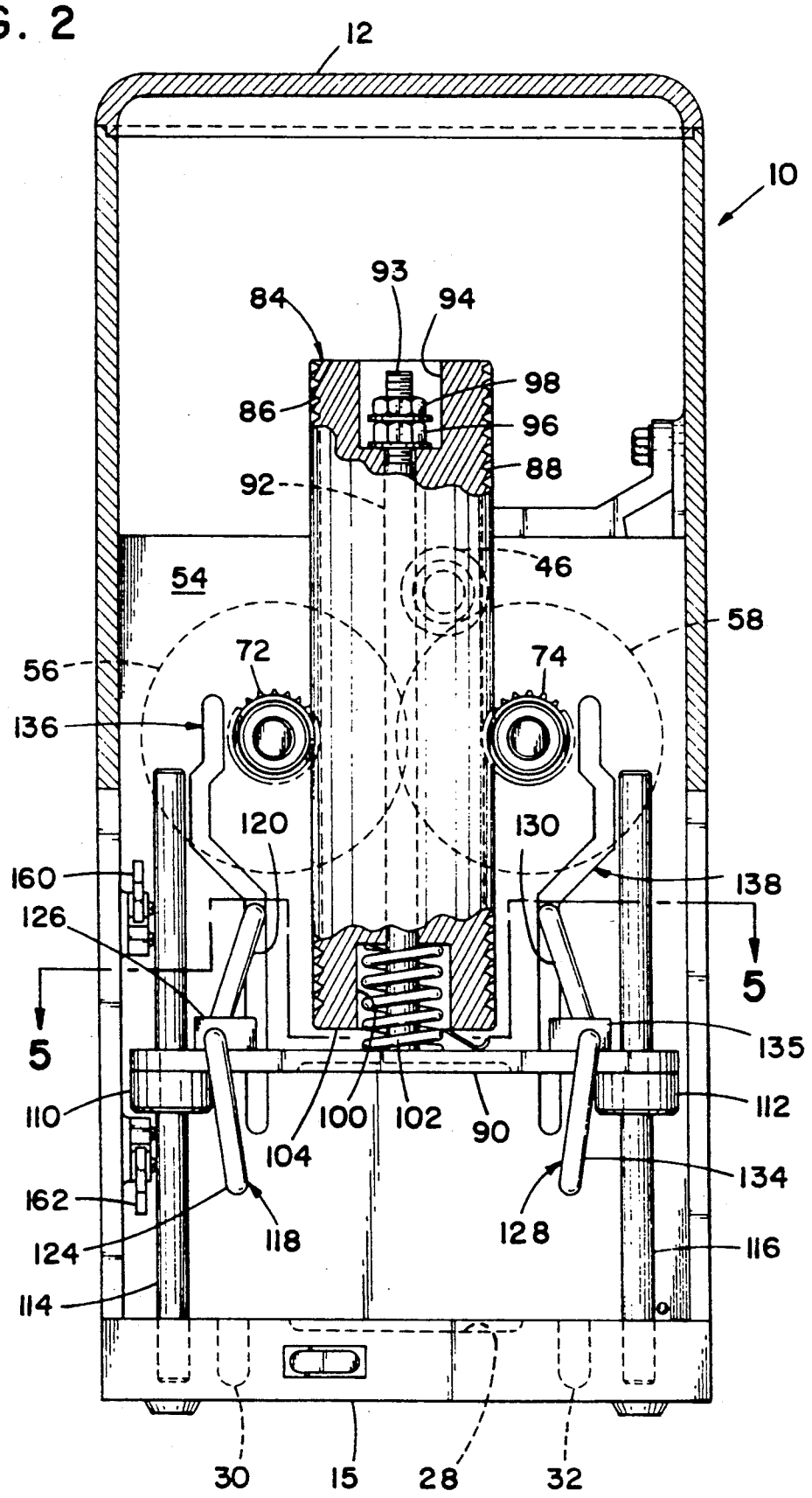
FIG. 2 is a front elevational view, taken partially in cross section, of the can crusher which is illustrated in FIG. 1.
Figure 3:
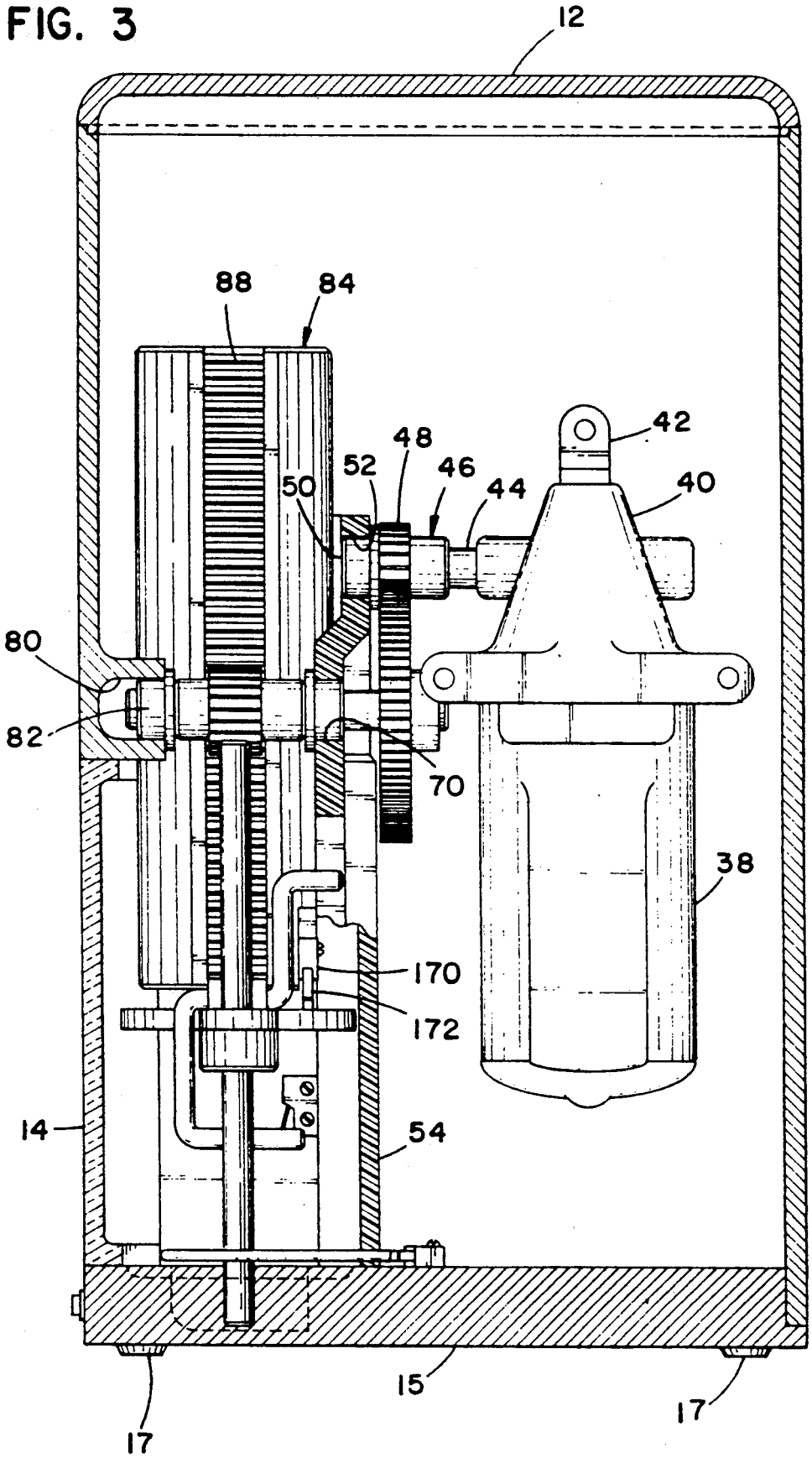
FIG. 3 is a side elevational view of the can crusher which is illustrated in FIGS. 1 and 2, taken partially in cross section.
Figure 4:
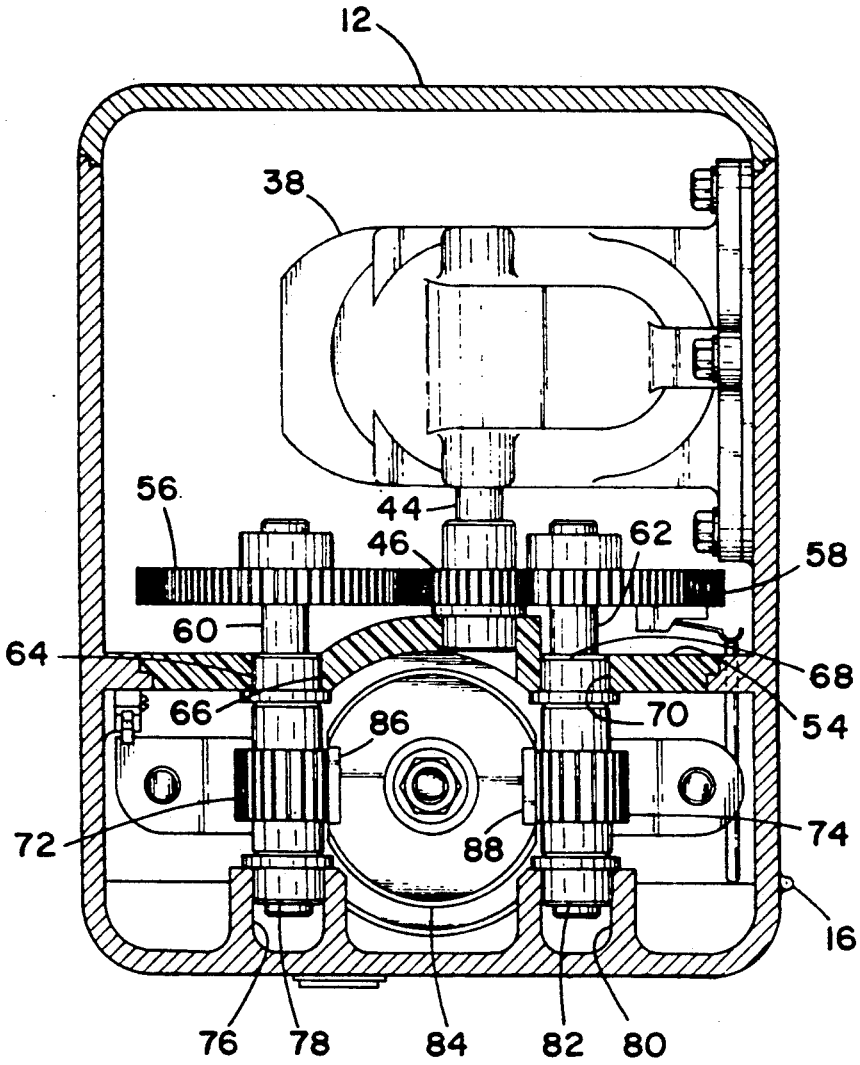
FIG. 4 is a top plan view of the can crusher which is depicted in FIGS. 1-3, taken partially in cross section.
Figure 5:
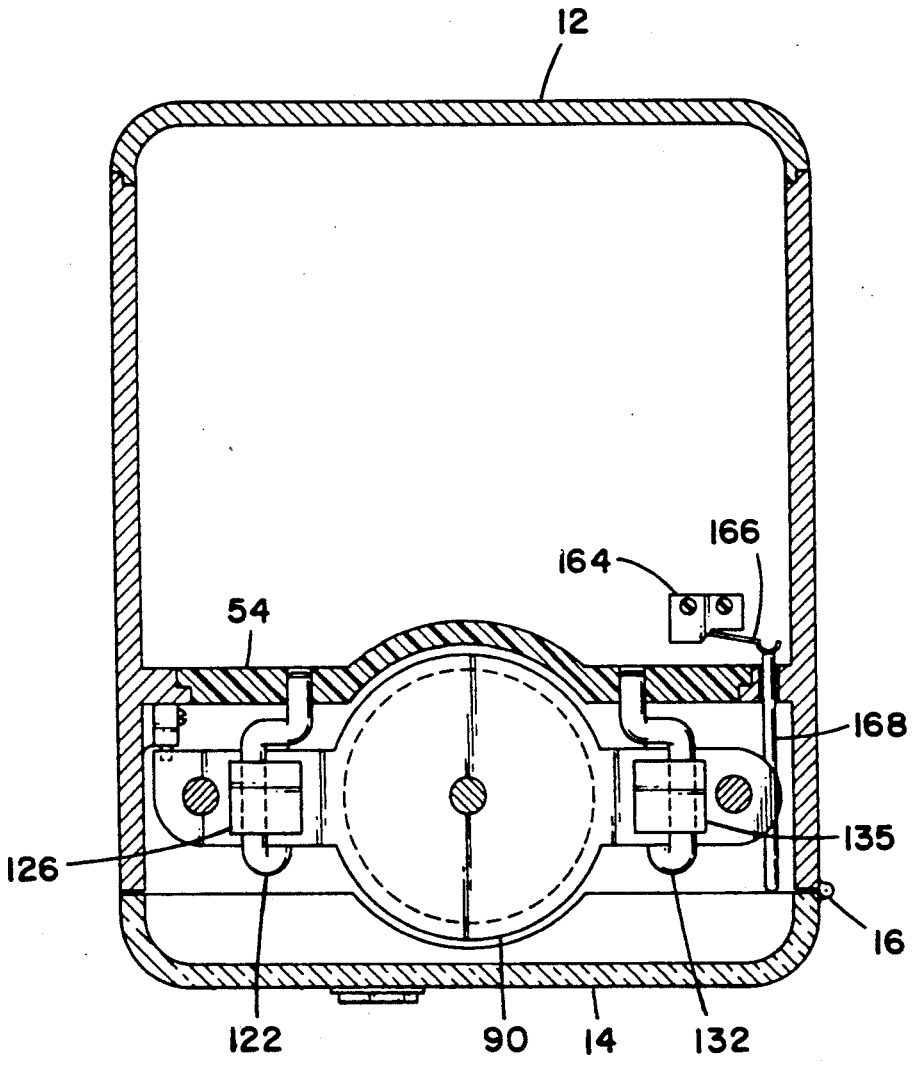
FIG. 5 is a cross sectional view which is taken along lines 5—5 in FIG. 2.

Looking now to FIGS. 1-5, a preferred drive mechanism 36 of the can crusher 10 will now be discussed. As may be seen best in FIGS. 1, 3 and 4, an electric motor 38 is secured to an inner surface of housing 12 by a number of support brackets 42. Motor 38 is integrally connected to a transfer case 40, which may have reduction gearing therein. The motor 38 and transfer case 40 may be commercially obtained as a single unit such as Dayton Model 2Z 802. As is perhaps best seen in FIG. 4, transfer case 40 has an output shaft 44 which is arranged to rotate a drive gear 46. As may be seen in FIG. 3, drive gear 46 is supported for rotation relative to an internal support member 54 of the housing 12 by a bearing 50, which is seated within a support bore 52. Drive gear 46 has teeth 48 which are meshed with corresponding teeth on a first transfer gear 58, as is best shown in FIGS. 2 and 4. First transfer gear 58 in turn is meshed with a second transfer gear 56. The first and second transfer gears 56, 58 are preferably of the same radius, so they will rotate at equal rates but in opposite directions.

Mounted for rotation with the first transfer gear 58 is a first transfer shaft 62, which is supported for rotation relative to the internal support member 54 by a bearing 68, which is seated in a bore 70. Likewise, a second transfer shaft 60 is mounted for rotation with the second transfer gear 56, and is supported for rotation relative to the internal support member 54 by a bearing 64 which is seated in a bore 66. As is best shown in FIG. 4, a first pinion 74 is mounted for rotation with the first transfer shaft 62, and a second pinion 72 is likewise mounted for rotation with second transfer shaft 60. The first pinion 74 is supported for rotation relative to housing 12 by a bearing 82, which is seated in a socket 80. Similarly, the second pinion 72 is supported for rotation relative to housing 12 by a bearing 78 which is seated in a socket 76.

Referring now to FIG. 2 in particular, an elongate vertically oriented axially movable rack member 84 is provided with a first toothed rack 88 and a second toothed rack 86, respectively, on opposite sides thereof. First toothed rack 88 is engaged with first pinion 74, and second toothed rack 86 is engaged with the second pinion 72.

Referring again to FIG. 2, a compression plate 90 is mounted beneath and perpendicular to the axis of movable rack member 84. Compression plate 90 is integral with a rod member 92, which has an upper threaded portion 93. The upper threaded portion 93 extends into a recess 94 which is defined in an uppermost portion of the movable rack member 84. A nut 96 is threadedly engaged with the threaded portion 93 of rod member 92 to adjust the maximum pressure between rack member 84 and compression plate 90 by compressing spring 102. A locknut 98 is also threaded onto portion 93 to secure the nut 96 in a desired position relative to rack member 84.

Looking again to FIG. 2, a second cylindrical recess 100 is axially defined in a bottom surface 104 of rack member 84. A helical compression spring 102 is positioned within recess 100 to provide resilient compression bias between rack member 84 and compression plate 90, for reasons which will be set forth in greater detail below.

Looking now to FIG. 1, it will be noted that compression plate 90 includes a first radially extending end portion 108 and a second radially extending portion 106. Slide bearing sleeves 110, 112 are provided on outermost ends of the first and second end portions 106, 108, respectively. Slide bearing sleeve 112 is fitted for axial sliding movement with respect to a first elongate vertically oriented guide post 116. Similarly, the second slide bearing sleeve 110 is fitted for linear sliding movement with respect to a second vertically oriented guide post 114. In this way, compression member 90 is constrained for vertical linear movement with respect to housing 12 and any underlying support surface.

Looking again to FIG. 2, crusher 10 is further provided with a first crimper element 128 and a second crimper element 118. First crimper element 128 includes a cam follower end 130, a linear horizontal portion 132 and a crimping end 134 which is adapted to engage the workpiece. As is perhaps best shown in FIG. 5, the linear horizontal portion 132 is pivotally mounted with respect to a first bearing block 135, which is integral with compression plate 90. Likewise, second crimper element 118 is provided with a cam follower end 120, a linear horizontal portion 122 and a crimping end 124 which is adapted to engage a second side of the workpiece that is opposite the side which is to be engaged by the crimping end 134 of first crimper element 128. As may also be seen in FIG. 5, the linear horizontal portion 122 of second crimper element 118 is pivotally mounted with respect to a second bearing block 126, which is also integral with the compression plate 90. Referring again to FIG. 2, a first cam guide track 138 and a second cam guide track 136 are defined in the internal support member 54. Looking briefly to the diagrammatical view which is provided in FIG. 6A, the first guide track 138 includes a substantially vertical uppermost first track portion 150, an outwardly tapered downwardly extending second track 152 which begins at the lowermost end of first track portion 150, a vertically extending third track portion 154 which extends downwardly from a lowermost end of second track portion 152, a fourth downwardly extending inwardly tapered track portion 156 which begins from the lowermost end of third track portion 154 and a fifth vertical track portion 158 which is connected to a lower end of fourth track portion 156 and has a vertical extent which is substantially longer than the combined vertical extent of the previously mentioned track portions 150, 152, 154 and 156.

As may be seen in FIG. 2 and in diagrammatical views FIGS. 6A–6D, first guide track 138 and second guide track 136 are substantially symmetrical to each other. Accordingly, second guide track 136 is provided with a first upper track portion 140, a second outwardly tapered track portion 142, a third vertical track portion 144, a fourth inwardly tapered track portion 146 and a fifth vertical track portion 148 which corresponds to and is symmetrical with the fifth track portion 158 of first guide track 138.

Looking now to FIG. 1, a first upper limit switch 160 and a second lower limit switch 162 are mounted to the internal support member 54 at predetermined vertical positions which correspond to the desired limits of the crusher stroke of the compression plate 90. The switches 160, 162 are both positioned to be engaged by the second end portion 106 of compression plate 90 as it is driven upwardly and downwardly by drive mechanism 36. As is perhaps best shown in FIG. 5, a door sensor switch 164 is positioned within housing 12 and is arranged to be actuated by a push rod 168 which is supported for linear movement within a sleeve which is defined in internal support member 54. Push rod 168 is engageable by door 14 when door 14 is in its closed position. As a result, sensor switch 164 closes when door 14 is completely shut and latched by a detent or magnetic clip.

Looking again to FIG. 3, an overpressure limit switch 170 is mounted to rack member 84 and has an actuator 172 which is in contact with an upper surface of compression plate 90. Overpressure limit switch 170 is constructed so as to open when the compressive force between plate 90 and the work piece exceeds a predetermined limit, which will cause spring 102 to deflect to the degree necessary to actuate switch 170.

Figure 7:
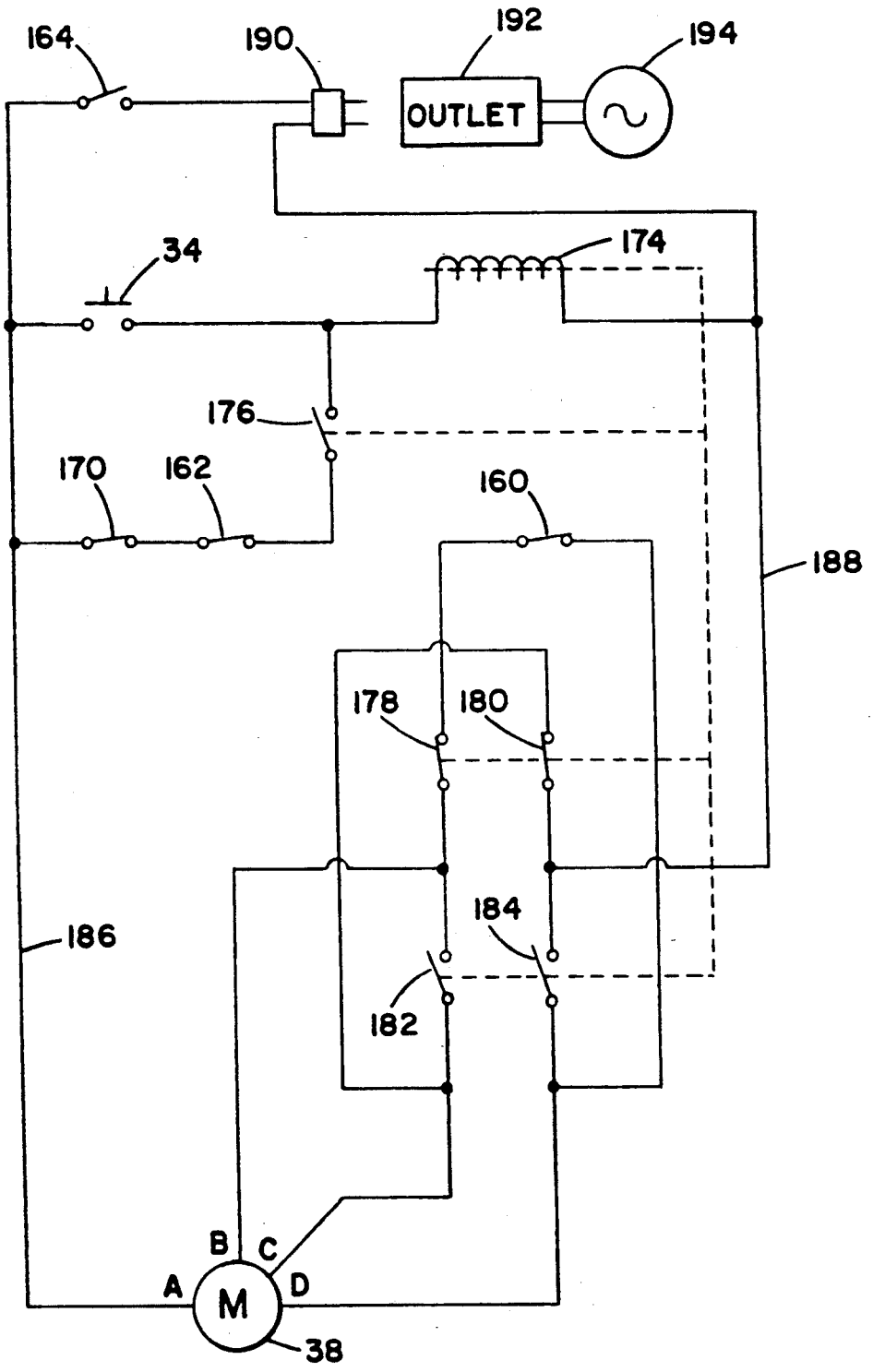
FIG. 7 is a schematic diagram of a control system which is used in the can crusher illustrated in FIGS. 1-6D.

FIG. 7 is a schematic diagram of the control system for the crusher apparatus 10. In addition to the components which have been previously described, FIG. 7 depicts a relay solenoid 174, a first relay switch 176, a second relay switch 178, and a third relay switch 180. A fourth relay switch 182 and a fifth relay switch 184 are also actuatable by relay solenoid 174. A first power supply bus 186 and a second power supply bus 188 are adapted to provide electric power which is initially supplied by an AC power source 194. In the preferred embodiment, crusher 10 will have an electric plug 190, which fits into an outlet 192 of a common electric power distribution system.

The operation of a crusher apparatus 10 constructed according to the above-described embodiment will now be discussed. An operator first opens door 14 to expose opening 18 and places a workpiece such as an aluminum or steel can into the opening 18. The workpiece is positioned within the space which is defined between compression plate 90 and base 15, with the lower surface thereof preferably being seated within depression 28. Once the workpiece is so positioned, the operator then closes door 14, which causes push rod 168 to contact the actuator 166 of the door sensor switch 164, thus closing the door safety switch 164.

At this point, the operator may then depress start button 34. Referring to FIG. 7, depression of start button 34 causes the start switch to close, which in turn energizes relay solenoid 174. As a result, the normally open relay switches 176, 182 and 184 are all caused to close. Simultaneously, the normally closed relay switches 178, 180 are caused to open. Since overpressure limit switch 170 and lower limit switch 162 are normally closed, the closure of first relay switch 176 completes the circuit between first supply bus 186 and second supply bus 188, thus causing relay solenoid 174 to remain energized. This maintains switches 182, 184 in their closed position. As a result, power from second supply bus 188 is supplied to terminal D of motor 38. Power from first supply bus 186 is supplied to terminal A of motor 38.

Figure 6B:
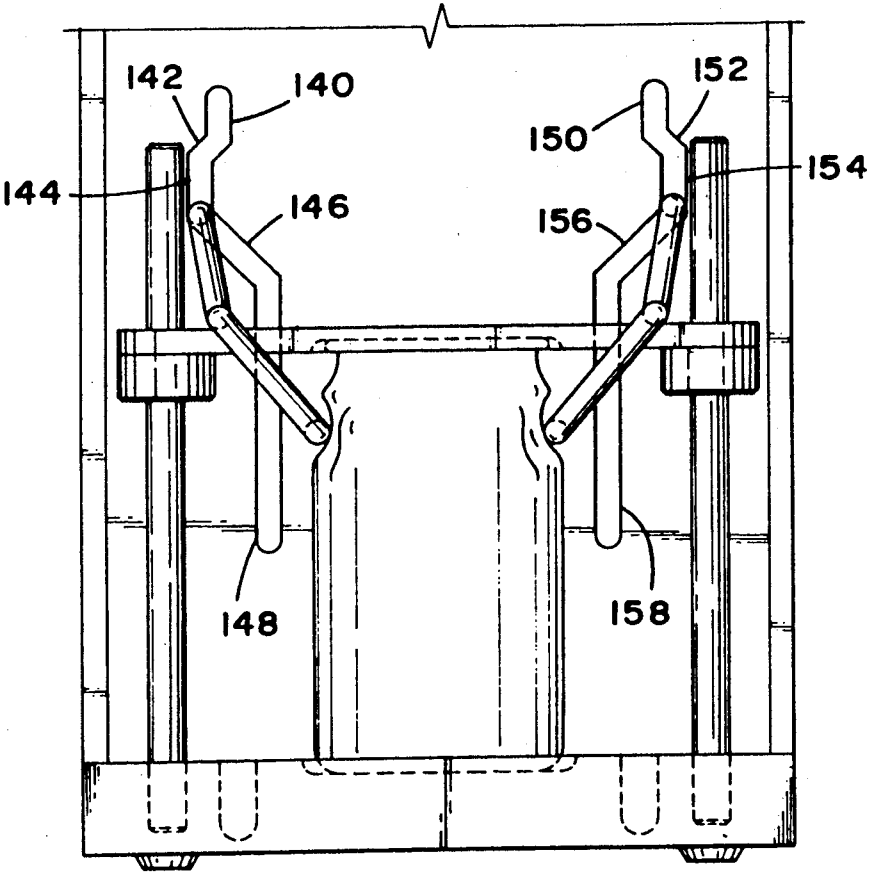
FIG. 6B is a fragmentary operational view of the crimper in a second operational position.
Figure 6A:
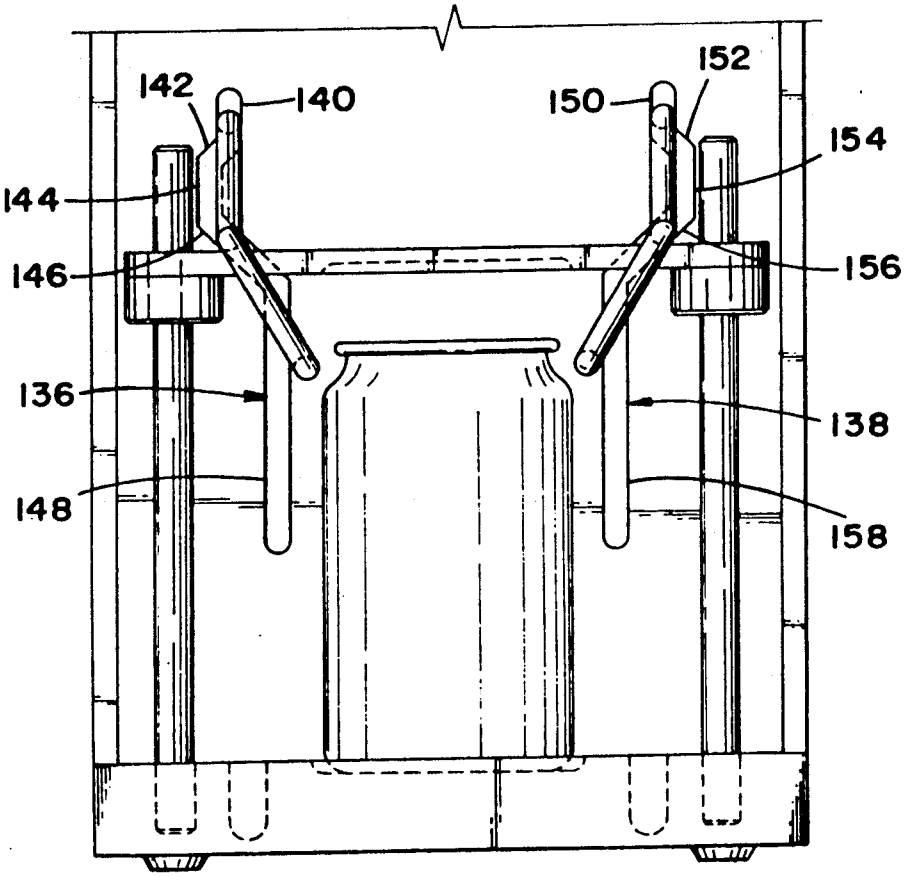
FIG. 6A is a fragmentary operational view of a crimper of the can crusher which is illustrated in FIGS. 1-5 in a first operational position.
Figure 6D:
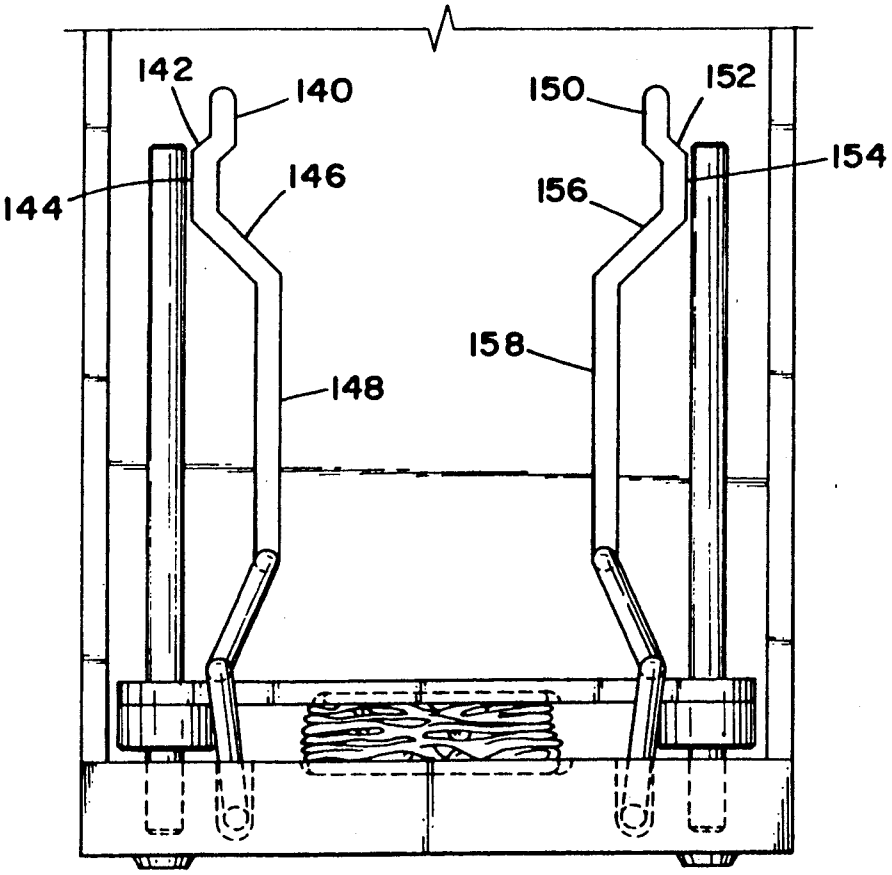
FIG. 6D is a fragmentary operational view of the crimper in a fourth operational position.
Figure 6C:
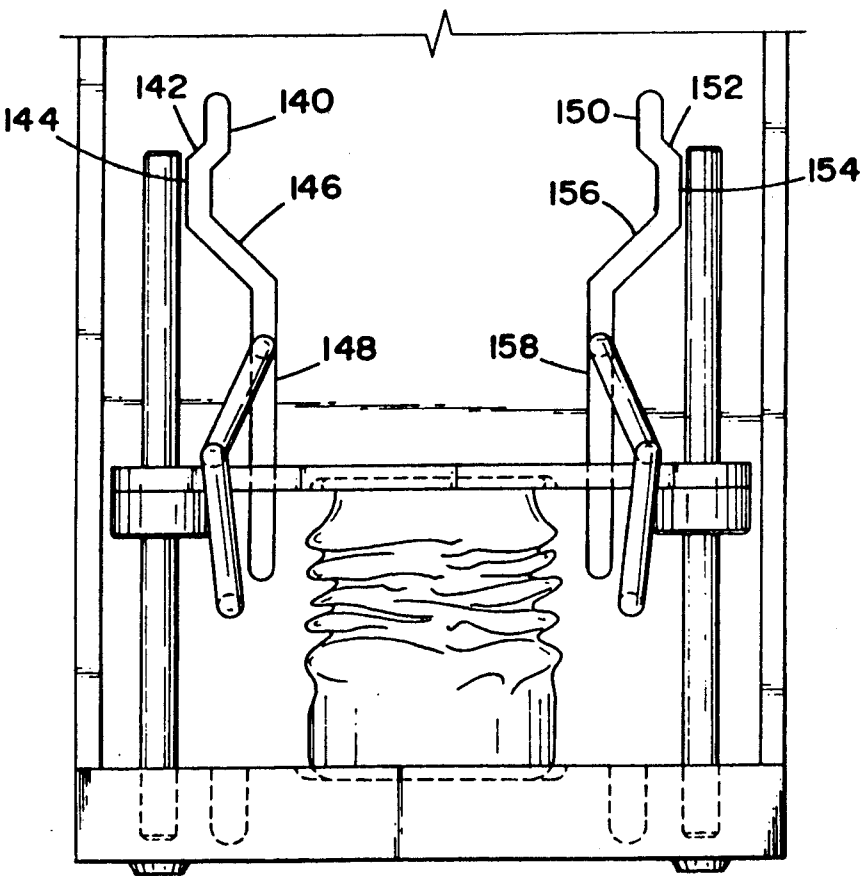
FIG. 6C is a fragmentary operational view of the crimper in a third operational position.

Motor 38 will operate in a forward direction when AC power is supplied to leads A, D and when leads B and C are connected to each other. It will operate in a reverse direction when leads A, C are connected to a source of AC power, and when leads B, D are connected to each other. Thus, motor 38 is initially caused to rotate in its forward direction when start button 34 is pressed. This causes drive gear 46 to rotate in a clockwise direction as viewed in FIG. 2, which in turn drives first transfer gear 58 in a counterclockwise direction. Second transfer gear 56, being engaged with first transfer gear 58, turns in a clockwise direction. The second and first pinions 72, 74 turn in a clockwise and counterclockwise direction, respectively. As a result, movable rack member 84 and compression plate 90 are caused to move linearly downwardly toward the workpiece. As compression plate 90 begins its downward stroke, the second and first cam follower ends 120, 130 of the second and first crimper elements 118, 128, respectively, ride within the uppermost first track portions 140, 150 of the respective guide tracks 136, 138. At this point, the crimping ends 124, 134 of the second and first crimper elements 118, 128, respectively, are positioned outwardly so they do not engage the intended workpiece. As compression plate 90 continues to move downwardly to the position which is indicated in FIG. 6B, follower ends 120, 130 travel through the second track portions 142, 152 and enter the third track portions 144, 154. At this point, the crimping ends 124, 134 engage the outer surface of the workpiece, and exert enough force on the outer surface to crimp the workpiece. As compression plate 90 moves further down, the follower ends 120, 130 move through the fourth and fifth track portions 146, 148 and 156, 158 respectively. At this point, the crimping ends 124, 134 again move outwardly with respect to the workpiece, and eventually become seated at the end of the stroke within the first and second grooves 30, 32 which are defined in base 15. Since the workpiece is crimped, the force required to crush it is less than would otherwise be necessary.

If, during the downward traverse of compression plate 90, the compressive force becomes dangerously high, as may be the case when a heavy gauge steel can is placed within an apparatus that is designed for crushing steel or aluminum beverage cans, compression spring 102 will deflect, and overpressure limit switch 170 will open, thus de-energizing relay solenoid 174. At this point, the second supply bus 188 ceases to be connected to terminal D of motor 38, and terminals B and C are no longer communicated to each other, due to the opening of switches 182, 184. However, the closing of second switch 178 and third switch 180 cause power from second supply bus 188 to be connected to terminal C, and for terminals B and D to be communicated with each other. As a result, motor 38 is reversed, thus causing compression plate 90 to be withdrawn to its upper position. When upper limit switch 160 is actuated by the first end portion 106 of compression plate 90, the connection between terminals B and D will be broken, thus ceasing operation of motor 38.

Similarly, if plate 90 reaches the end of its intended stroke, lower limit switch 162 is engaged by the first end portion 106 of compression plate 90. This opens lower limit switch 162, thus de-energizing relay solenoid 174 and causing reversal of motor 38 and shutoff at the end of the upward stroke in a manner which is identical to that described above. Also, if door 14 is opened during the above-described cycle, this opens switch 164, thus de-energizing relay solenoid 174. This stops motor 38. Closing door 14 causes reversal of motor 38 and shutoff at the end of the upward stroke. At this point, the operator can open door 14 and remove the now crushed workpiece from opening 18. Once the workpiece is removed, door 14 may again be closed until the operator again intends to use the crusher 10.

Figure 8:
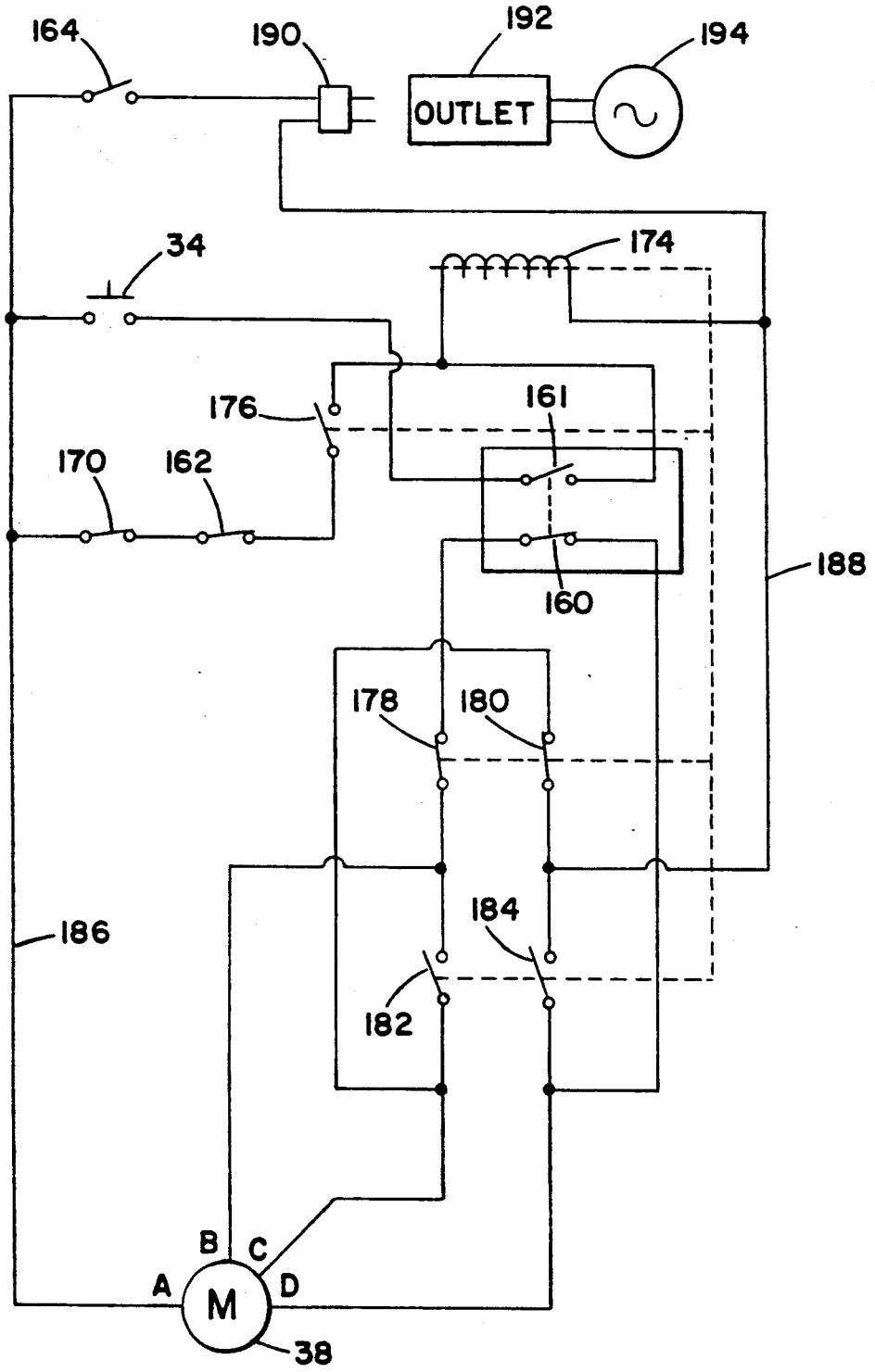
FIG. 8 is a schematic diagram of an alternative preferred embodiment of a control system which is used in the can crusher illustrated in FIGS. 1-6D.

FIG. 8 is a schematic diagram of an alternative preferred control system for the crusher apparatus 10. The alternative control system includes the addition of restart contact 161 which is connected between start switch 34 and relay solenoid 174 in cooperation with upper limit switch 160. The restart contact 161 is shown in FIG. 8 in its open position which coincides with the upper limit switch 160 being closed to enable motor 38 to operate and compression plate 90 to complete its downward stroke and be withdrawn to its upper position as described above with reference to FIG. 7. With restart contact 161 open, the start switch 34 is disabled and relay solenoid 174 cannot be energized by depressing start button 34. When the upper limit switch 160 opens after being actuated by the first end portion 106 of compression plate 90 as the compression plate 90 is withdrawn to its upper position, restart contact 161 is closed to enable start switch 34 to be depressed and relay solenoid 174 to be energized.

The addition of restart contact 161 prevents the user from keeping the compression plate 90 at the lower, limit of the downward stroke by depression of the start button 34 prior to the upper limit switch 160 being actuated after the relay solenoid 174 is de-energized by the opening of overpressure limit switch 170 or lower limit switch 162. It also prevents the user from continuously energizing the relay solenoid 174 by continuous depression of the start button 34. Continuously energizing the solenoid 174 would keep the compression plate 90 at the lower limit of the downward stroke and could cause damage to the apparatus because of virtual override of the overpressure limit switch 170. For example, if an incompressible object is placed within the apparatus, continuous pressure on the object cannot be applied by continuous depression of the start button 34.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

We claim:

1. An apparatus for crushing a workpiece such as a can, comprising:

a housing having an opening defined therein for receiving a workpiece, said housing including an internal support member having a guide track defined therein;

a compression member mounted for movement along a linear path within said housing;

drive means for moving said compression member along the linear path;

means for sensing compressive force between said compression member and said drive means and for generating a compressive signal representative of the compressive force thereat;

means within said housing which is adapted for initially crimping the workpiece, said crimping means being mounted for movement with said compression member and including means for engaging said guide track, said guide track being configured so as to urge said crimping means into the workpiece at an upper portion of the downward movement of said compression member, thereby reducing the amount of force which is needed to crush the workpiece;

means for controlling said drive means so that, upon actuation, said compression member is caused to move from an initial position downwardly to a lower limit position, and then upwardly to the initial position, whereby a can or like object which is positioned within the opening may be crushed;

said means for controlling including means for receiving said compressive signal and for causing movement of said compression member upwardly toward the initial position if, after said drive means is actuated and said compression member is moved at least partially downwardly, said compressive signal represents a compressive force greater than a predetermined amount.

2. An apparatus for crushing a workpiece such as a can, comprising:

a housing having an opening defined therein for receiving a workpiece such as a can, said housing including an internal support member having a guide track defined therein;

a compression member mounted for movement along a linear path within said housing;

drive means for moving said compression member along the linear path, said drive means including an elongate, axially movable rack member, said rack member being substantially centered above said compression member and having first and second toothed racks, respectively, on opposite sides thereof, said drive means further comprising a motor, and transferring means to transmit force from said motor to said first and second toothed racks, whereby force is transmitted evenly to said compression member so as to lessen the possibility of jamming; and means within said housing which is adapted for initially crimping the workpiece, said crimping means being mounted for movement with said compression member and including means for engaging said guide track, said guide track being configured so as to urge said crimping means into the workpiece at an upper portion of the downward movement of said compression member, thereby reducing the amount of force which is needed to crush the workpiece.

3. An apparatus for crushing a workpiece such as a can, comprising:

a housing having an opening defined therein for receiving a workpiece, said housing including an internal support member having a guide track defined therein;

a compression member mounted for movement along a linear path within said housing between an initial position and a lower limit position;

drive means for moving said compression member along the linear path;

means within said housing which is adapted for initially crimping the workpiece, said crimping means being mounted for movement with said compression member and including means for engaging said guide track, said guide track being configured so as to urge said crimping means into the workpiece at an upper portion of the downward movement of said compression member, thereby reducing the amount of force which is needed to crush the workpiece;

actuation means for actuating said drive means;

control means for controlling said drive means so that, upon actuation of said drive means, said compression member is caused to move from the initial position downwardly to the lower position, and then upwardly to the initial position; and disabling means for disabling said actuation means after said drive means is actuated until said compression member is moved upwardly to the initial position after being moved downwardly toward the lower limit position.

4. The apparatus of claim 3, further comprising an upper limit switch for sensing when said compression member is in said initial position, said actuation means including a start switch for actuating said drive means, and said disabling means including an enabling contact connected between said start switch and said drive means and in cooperation with said upper limit switch such that when said upper limit switch senses that said compression member is in said initial position then said actuation means is enabled to allow for actuating of said drive means.

* * * * *